United States Patent [19]

Squire et al.

[11] 4,168,645

[45] Sep. 25, 1979

[54] ELECTRONIC MUSICAL INSTRUMENT

[75] Inventors: Morris B. Squire, 555 Wilson La., Des Plaines, Ill. 60016; Donald F. Dimon, Arlington Heights, Ill.

[73] Assignee: Morris B. Squire, Des Plaines, Ill.

[21] Appl. No.: 799,084

[22] Filed: May 20, 1977

[51] Int. Cl.[2] ..... G10H 1/00

[52] U.S. Cl. ..... 84/1.01; 84/1.11; 84/1.19

[58] Field of Search ..... 179/1 M, 1 SA, 1 SB, 179/1 SC, 1 SD, 1 SE-1 SP, 1 J; 84/1.01, 1.03, 1.11, 1.19, 1.24, 1.28, 1.27, 1.21, 1.12

[56] References Cited

U.S. PATENT DOCUMENTS

| | | | |
|---|---|---|---|
| Re. 29,010 | 10/1976 | Spence | 84/1.01 |
| 3,166,622 | 1/1965 | Neustadt | 84/1.01 |
| 3,429,976 | 2/1969 | Tomcik | 84/1.12 |
| 3,456,062 | 7/1969 | Watson et al. | 84/1.01 |
| 3,476,863 | 11/1969 | Campbell | 84/1.01 |
| 3,484,530 | 12/1969 | Rupert | 84/1.28 X |
| 3,535,969 | 10/1970 | Bunger | 84/1.11 |
| 3,539,701 | 11/1970 | Milde | 84/1.26 X |
| 3,591,699 | 7/1971 | Cutler | 84/1.11 |
| 3,719,782 | 3/1973 | Barnum | 179/1 J |
| 3,767,833 | 10/1973 | Noble et al. | 84/1.19 X |
| 3,795,755 | 3/1974 | Uchiyama | 84/1.03 |
| 3,878,748 | 4/1975 | Spence | 84/179 M X |
| 3,999,456 | 12/1976 | Tsunoo et al. | 84/1.01 |

*Primary Examiner*—Ulysses Weldon

*Attorney, Agent, or Firm*—Wegner, Stellman, McCord, Wiles & Wood

[57] ABSTRACT

A voice-controlled electronic musical instrument provides tones responsive to audible energy imparted to a microphone. An analog voltage representative of the frequency of the audible energy imparted to the microphone controls a gate signal generator. The gate signal generator decodes the analog signal into a digital word having octave and note information. The octave and note information gates operator-selected musical tones to provide a desired output signal responsive to the audible energy applied to the microphone.

6 Claims, 4 Drawing Figures

OCTAVE DECODER 64

68
90
91
92
93
94
95
96
97
98
99
100
101
102
103
104
106
107
108
109
110
111
112
113
114
115
116
117
89
105
C
B
A#
A
G#
G
F#
F
E
D#
D
C#
e
d
c
b
a
ē
d̄
c̄
b̄
ā
ē
d̄
d
e
NOTE OF SCALE DECODER

ELECTRONIC MUSICAL INSTRUMENT

BACKGROUND OF THE INVENTION

This relation relates to the field of electronic musical instruments and, more particularly, to a musical instrument responsive to an analog signal. The analog signal may be generated in response to the reception of energy within the audible range.

Electronic organs usually have a plurality of operator-selectable tone generators capable of providing musical sounds, as clarinets, flutes, oboes, drums, violins, etc. These electronic instruments usually include decoding circuitry for decoding various notes and octaves. The decoding circuitry is responsive to the operator-controlled switches, the stops and the keyboard.

We have developed a musical instrument similar to an electronic organ, but rather than being responsive to operator-controlled switches and a keyboard, our instrument is responsive to audible energy imparted to a microphone by the operator.

SUMMARY OF THE INVENTION

A microphone is coupled to a frequency multiplier which provides a signal to a phase locked loop to generate an analog voltage proportioal to the frequency of the audible energy imparted to the microphone. The analog voltage is applied to a gate signal generator wherein the signal is converted to a succession of digital words. The digital words are decoded to provide octave and note of scale information which then gates selected tone generators.

It is a feature of the present invention to provide an analog signal responsive to audible energy for controlling an electronic musical instrument.

It is a feature of the present invention to provide a gate signal generator having an octave and note of scale decoder which is responsive to an analog signal.

Yet another feature of the invention is to provide an electronic musical instrument wherein the developed tone gating signals are responsive to audible energy imparted to a microphone.

Yet a further feature of the present invention is to provide a simplified gate signal generator that provides octave and note decoding with a minimum of parts.

Other features of the invention will become apparent when considering the specification in combination with the drawing in which:

DRAWING

DESCRIPTION OF PREFERRED EMBODIMENT

Figure 1A:
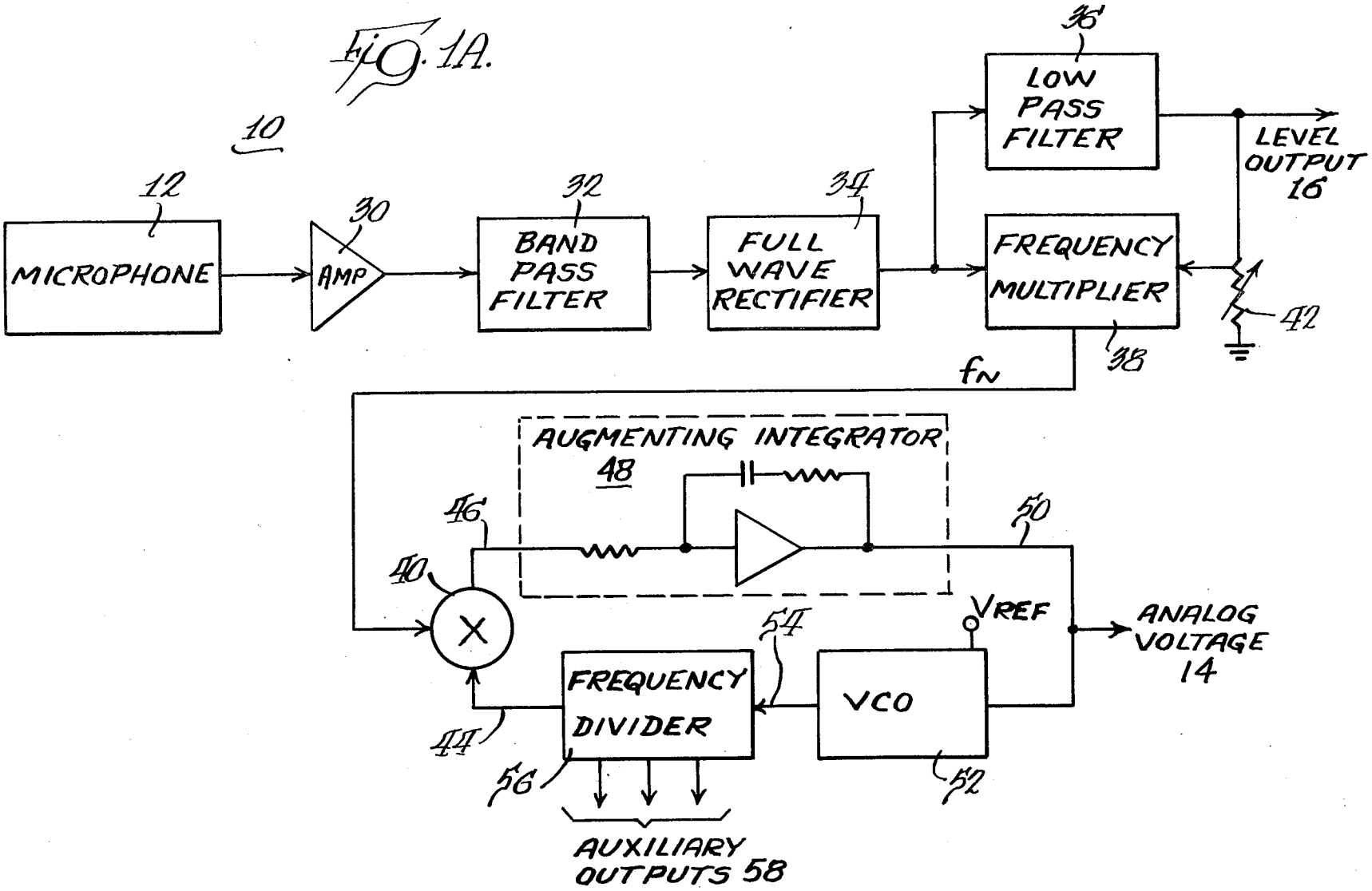
FIGS. 1A and 1B are block diagrams of the musical instrument.
Figure 1B:
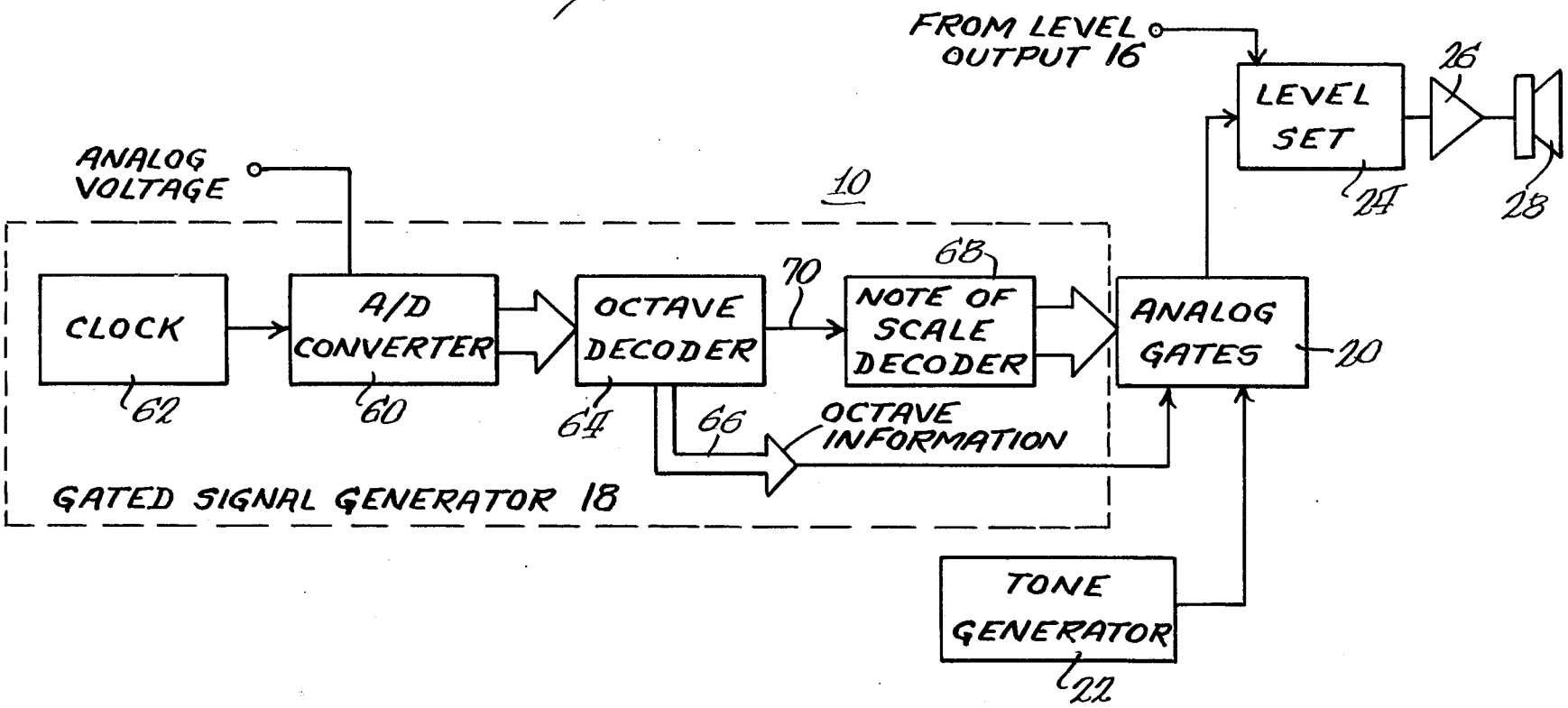

Referring to FIGS. 1A and 1B, electronic musical instrument 10 is shown. The operator of the instrument speaks, sings or hums into microphone 12 to produce an analog voltage 14, the amplitude being proportional to the frequency of the audible energy provided to microphone 12. The amplitude of the audible energy at microphone 12 is represented by the signal from level output 16.

The analog voltage 14 is connected to gate signal generator 18 which provides octave and tone gate signals for the frequency represented by the amplitude of the analog voltage 14. The gate signals generated are applied to the analog gates 20 which gate the outputs of the plurality of tone generators 22 to provide a corresponding tone responsive to the amplitude of the analog signal 14. The tones are provided to level set circuit 24. The amplitude of the tones on the output of the level set circuit 24 is proportional to the amplitude of the level output 16. Amplifier 26 amplifies the tones from level set circuit 24 and provides the amplified signal to speaker 28. Depending upon the harmonic content of the tones produced by tone generator 22, musical instrument 10 may have a variety of different musical sounds, as a clarinet, flute, oboe, drum, violin, etc. Irrespective of the tones produced, the output from speaker 28 is proportional to the frequency and the amplitude of the audible energy imparted to microphone 12.

Microphone 12 is responsive to energy having a frequency between approximately 100 and 1600 Hz. The output of microphone 12 is coupled to amplifier 30 which provides amplification of the signal within the audible range. The output of amplifier 30 is provided to a band pass filter 32 which removes all frequencies less than 100 Hz and greater than 1600 Hz. The signal from band pass filter 32 is applied to a full wave rectifier 34. The full wave rectifier rectifies the signal from band pass filter 32 into a signal having a single polarity. The output of the full wave rectifier 34 is applied to low pass filter 36 which removes all high frequencies generated as a result of the rectification. The output of filter 36 is a voltage having an amplitude which varies in accordance with the energy imparted to microphone 12. The output of the full wave rectifier 34 is also provided to frequency multiplier 38. The frequency multiplier 38 multiplies the frequency of the input signal by an integer N, as 2. Frequency multiplier 38 speeds up the response time of the circuit. The signal from the frequency multiplier 38 is applied to phase detector 40. Frequency multiplier 38 is also coupled to low pass filter 36. The frequency multiplier 38 is not operative unless the signal from full wave rectifier 34 exceeds a threshold voltage established by the variable resistor 42. Thus, the audible energy to microphone 12 must be sufficiently great to overcome the threshold voltage determined by variable resistor 42, as set by the operator.

The frequency of the signal from frequency multiplier 38 determines the amplitude of analog output 14. Phase detector 40 compares the frequency from frequency multiplier 38 to a phase locked loop frequency on line 44. The difference in frequencies is represented by an analog voltage provided on output line 46. The analog voltage on line 46 is provided to an augmenting integrator 48 which amplifies and integrates the signal on line 46 to provide analog output 14 at its output 50. To provide the phase locked loop voltage on line 44, the analog voltage 14 is coupled to a voltage-controlled oscillator 52, nominally 4 KHz, which generates a signal on line 54, the frequency of which is dependent upon the amplitude of the analog output 14. Specifically, when there is no difference between the frequency of the signal from multiplier 38 and the frequency of the signal on line 44 (i.e., the input of augmenting integrator 48 is zero), the frequency of the signal on line 54 is a whole number multiple of the frequency from frequency multiplier 38. The signal on line 54 is provided to frequency divider 56. The frequency divider 56 divides the whole number signal on line 54 by a fixed value. Thus, the voltage from analog output 14 follows or "tracks" the frequency from frequency multiplier 38. Auxiliary outputs 58 are also provided from frequency divider 56. Each auxiliary output signal represents a whole number division of the input frequency and may be used in a manner which will become apparent below.

The analog voltage 14 varies between 0 and approximately 10 volts, representing a frequency of approximately 100–1600 Hz. A/D converter 60 is clocked by clock 62 and generates 8-bit words representative of the amplitude of the analog signal. As is characteristic of most A/D converters, A/D converter 60 provides a succession of 8-bit words each of which is shifted to the right one position when the analog voltage input is divided in half. Thus, if the 8-bit word 10000000 represents 10 volts, the 8-bit word 01000000 represents 5 volts and the word 00100000 represents 2.5 volts.

Octave and frequency have a similar relationship in that the frequency of a note in the musical scale in one octave is exactly twice the frequency of the same note in the next lower octave.

The three most significant bits of each 8-bit word provide octave information of the signal imparted to microphone 12, and the note within the octave is available from the entire 8-bit word, as will be explained in greater detail below.

Octave decoder 64 determines which one of three octaves each 8-bit word represents. Octave information is provided to analog gates 20 by line 66 from octave decoder 64. Octave decoder 64 also provides a five-position window which acquires a binary code representing the note in the musical scale. The window selects five of the eight bits and the five bits that are selected depend on which octave has been decoded. The signals from the window are provided to note of scale decoder 68 by line 70 and convert the 5-bit code from the octave decoder to a 12-bit code representative of each note in the musical scale. The signals representing the notes are applied to analog gate 20 and control the gates in the well known manner. Analog gates 20 gate the signals from the tone generator 22 in the well known manner.

Figure 2:
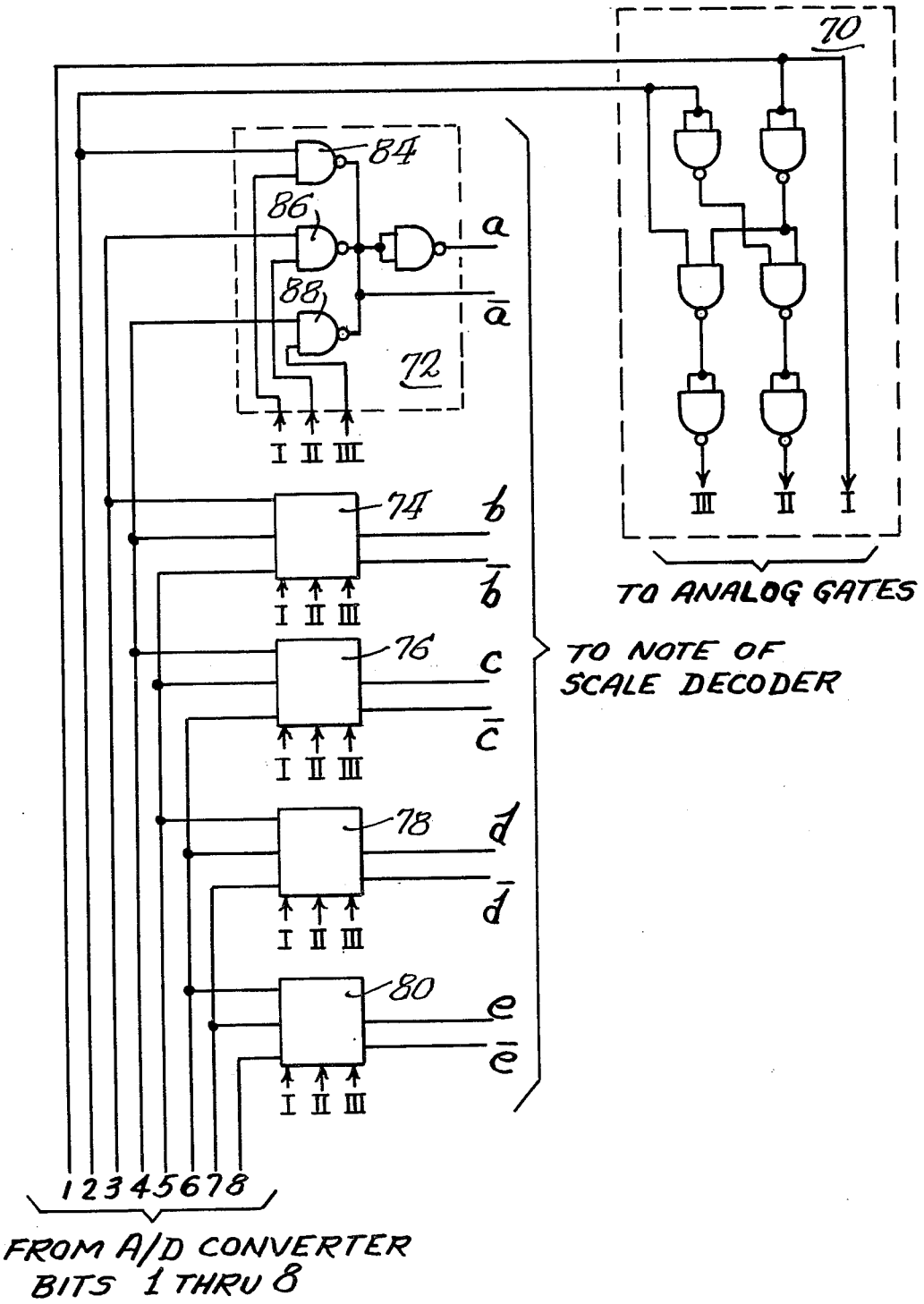
FIG. 2 is a schematic diagram of the octave decoder shown in FIG. 1B.

Referring to FIG. 2, the operation of octave decoder 64 will now be described. During the description it is helpful to recall that a binary word, as 10001000, which represents a note in one octave, will be shifted one place to the right (i.e., 01000100, and will represent the same note in the next lower octave since the analog voltage representing the latter note is half that of the former. The six NAND gates in the octave logic circuit 70 provide 3-bit words 001, 010 and 100, indicative of octaves I, II and III, respectively. Although the octave logic circuit is shown to provide only three octaves, a greater number of octaves may be provided by increasing the word size from A/D converter 60 or providing for a more complex decoding circuitry. Comparators 72, 74, 76, 78 and 80 provide the five-position window which acquires note information and provides that information to lines a, b, c, d and e (and their inverted signals). The five comparators are analogous to a five-pole, three-position switch that selects: bits 4–8 and provides information regarding those bits to lines a–e for octave I; bits 3–7 and provides information regarding those bits to lines a–e for octave II; bits 2–6 and provides information to lines a–e for octave III. Thus, lines a–e and lines $\overline{a-e}$ always contain information regarding a note in the musical scale irrespective of the octave information provided by the three most significant bits.

Similarly constructed comparators 72, 74, 76, 78 and 80 are best understood by considering the operation of comparator 72. NAND gates 84, 86 and 88 are provided with octave I, II and III information. Depending upon the octave represented, a single one will be provided to one of the NAND gates. The NAND gate receiving the one is enabled, and the output a and $\bar{a}$ represent the state of the bit coupled to the enabled NAND gate. Thus, if bit 2 were one, indicating octave II, NAND gate 86 would be enabled, providing bit 3 information to a and $\bar{a}$.

Figure 3:
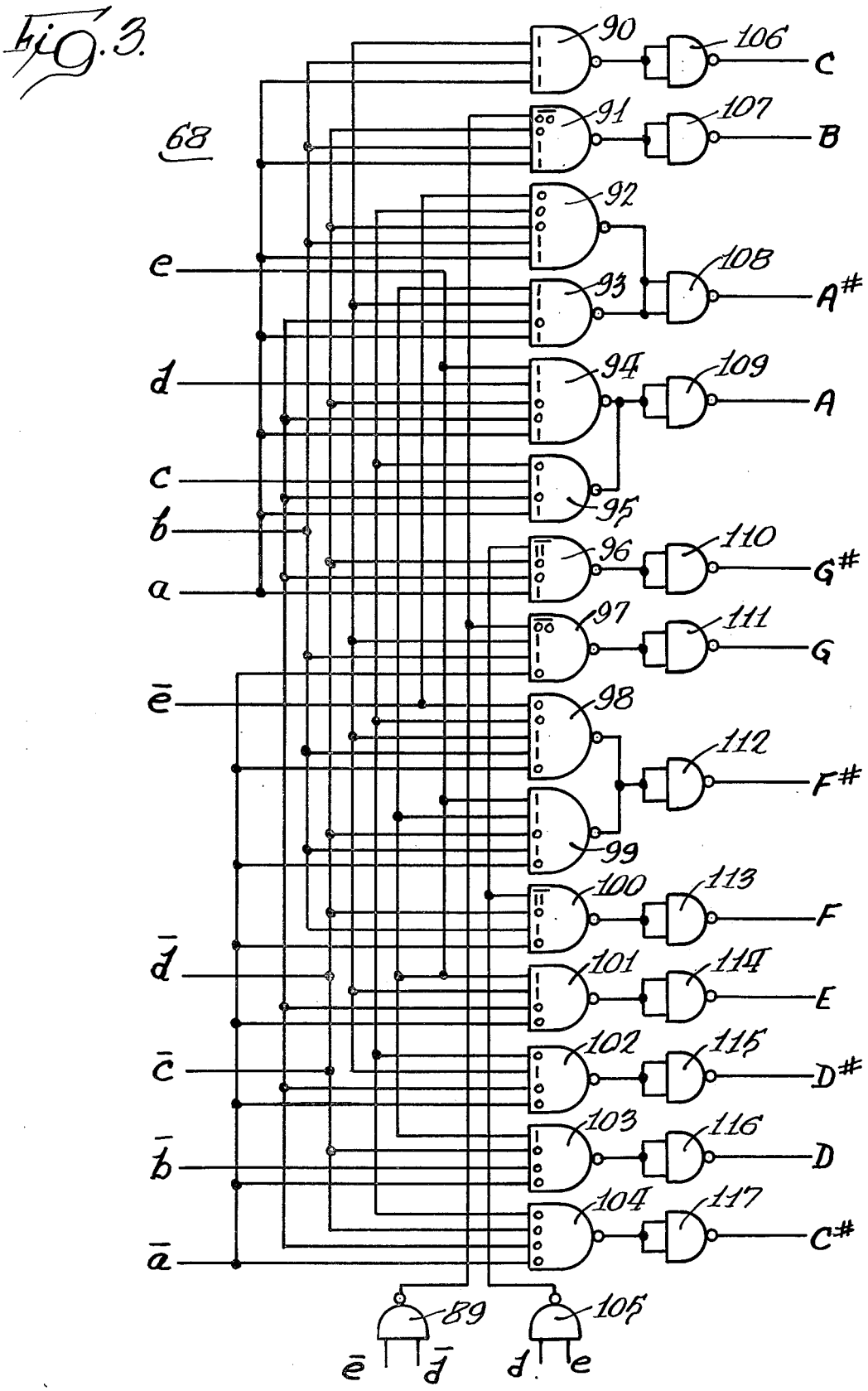
FIG. 3 is a schematic diagram of the note of scale decoder shown in FIG. 1B.

Referring to FIG. 3, the information from lines a–e and $\overline{a-e}$ is provided to note of scale decoder 68. The note of scale decoder translates the a–e and the $\overline{a-e}$ information from octave decoder 64 into signals for switching the twelve notes of each scale. Although any particular decoding scheme can be employed to accomplish the translation, the decoding scheme provided by NAND gates 89–105 and their corresponding interconnection between lines a–e and $\overline{a-e}$ provide a simplified method of decoding. The outputs of NAND gates 90, 91, 96, 97 and 100–104 are coupled through inverters 106, 107, 110, 111 and 113–117, respectively. NAND gates 92 and 93, 94 and 95 and 98 and 99 are each coupled together by NAND gates 108, 109 and 112, respectively. The decoding sequence of NAND gates 90–104 is shown by the binary notation within the gate. For example, referring to NAND gate 94, a code of 11001 provides an output pulse from NAND gate 94. Referring to NAND gate 96, an output pulse is provided for the input signal of 1011 as well as 1000.

Signals representing each of the twelve notes of the musical scale are provided for NAND gates 106 and 107 and may be applied to any well known analog gate circuit. The information regarding the note of scale is combined with the octave information by analog gate 20 to gate the tones from the tone generator 22.

The construction of other embodiments will be apparent. For example, the auxiliary outputs 58 of FIG. 1A could be combined in well known stop switches (not shown) and then provided to filters and audio amplification systems. In this case, analog voltage 14 would not be used, and unusual musical tones could be provided.

Finally, the electronic musical instrument may be operated as above or as an accompaniment to a well known electronic organ.

We claim:

1. In an electronic musical instrument having a plurality of tone generators and a plurality of gates responsive to gating signals for selecting tone generator outputs, an improved gating signal generator responsive to an analog signal representing audible energy comprising:

means for generating an analog signal, the amplitude of which is proportional to the frequency of the audible energy;

analog-to-digital converting means responsive to said analog signal for providing a succession of binary coded words wherein each word represents an octave and a note within the octave; and means responsive to the binary coded words for providing gating signals for the gates wherein each gating signal is indicative of the octave and the note within the octave of each coded word.

2. The electronic musical instrument of claim 1 wherein the means responsive to the binary coded words include:

means for detecting the octave represented by the digital word;

means for detecting the note represented by the digital word; and means responsive to the octave and the note detecting means for providing gating signals to the tone generators.

3. An electronic musical instrument responsive to energy within the audible range comprising:

means for converting energy within the audible range to a first signal proportional to the energy, the amplitude of the first signal representing the amplitude of the energy and the frequency of the first signal representing the frequency of the energy;

means for multiplying the frequency of the first signal by N to provide a second signal having the frequency N times the frequency of the energy;

means for generating an analog voltage representative of the frequency of the second signal;

means for converting the analog voltage into a succession of binary coded words;

decoder means responsive to the binary coded words for determining the octave and the note within the octave of the audible energy;

means responsive to the decoder means for generating gate signals representative of the notes and octaves of the audible energy; and means responsive to the gate signals for providing musical tones.

4. The electronic musical instrument of claim 3 in which the means for generating an analog voltage includes:

means for generating a phase locked loop signal at a frequency proportional to the analog voltage;

a phase detector for comparing said second signal to the phase locked loop signal, the output of the phase detector providing a voltage representing the difference between the frequency of the phase locked loop signal and said second signal;

augmenting integrator means responsive to the difference voltage for providing the analog voltage, wherein said means for generating a phase locked loop signal includes a voltage-controlled oscillator, the frequency of which is proportional to the analog voltage.

5. The electronic musical instrument of claim 4 further including:

a frequency divider means connected between the voltage-controlled oscillator and the phase detector for providing the phase locked loop signal to the phase detector and to provide several auxiliary output signals each having a fixed frequency with respect to the phase locked loop signal.

6. The electronic musical instrument of claim 3 further including:

means responsive to the amplitude of the first signal representing the amplitude of the energy for controlling the amplitude of the musical tones.

* * * * *